US009062942B1

(12) United States Patent
Calvert

(10) Patent No.: US 9,062,942 B1
(45) Date of Patent: Jun. 23, 2015

(54) POWERED TELESCOPING KNIFE HANDLE

(71) Applicant: PTKH Associates, Trustee for Powered telescoping knife handle CRT Trust, Manassas, VA (US)

(72) Inventor: S. Mill Calvert, Manassas, VA (US)

(73) Assignee: PTKH Associates, Manassas, VA (US), Trustee for Powered telescoping knife handle CRT Trust ( * ) Notice: Subject to any disclaimer, the term of this patent is extended or adjusted under 35 U.S.C. 154(b) by 0 days.

(21) Appl. No.: 14/523,486

(22) Filed: Oct. 24, 2014

(51) Int. Cl.
*F41F 5/00* (2006.01)
*B64D 1/04* (2006.01)
*F42B 3/00* (2006.01)

(52) U.S. Cl.
CPC ..... *F42B 3/006* (2013.01)

(58) Field of Classification Search
CPC ..... F42B 3/006; Y10S 30/04
USPC ..... 89/1.14
See application file for complete search history.

(56) References Cited

U.S. PATENT DOCUMENTS

| | | | | |
|---|---|---|---|---|
| 776,191 | A | 11/1904 | Lynch | |
| 1,755,646 | A * | 4/1930 | Halstead | 99/419 |
| 2,213,435 | A * | 9/1940 | Temple, Jr. | 227/9 |
| 2,276,259 | A * | 3/1942 | Temple, Jr. | 83/861 |
| 2,766,525 | A * | 10/1956 | Hoffman | 30/228 |
| 2,897,799 | A * | 8/1959 | Stupian | 60/636 |
| 3,932,953 | A | 1/1976 | Sharp | |
| 4,052,808 | A | 10/1977 | Crabtree | |
| 4,646,799 | A * | 3/1987 | Cobb | 144/195.3 |
| 4,872,231 | A * | 10/1989 | Gustavsen | 7/103 |
| 5,703,315 | A * | 12/1997 | Coggan | 89/1.14 |
| 5,711,079 | A * | 1/1998 | Fischer et al. | 30/342 |
| 6,883,264 | B1 | 4/2005 | Gimbel | |
| 2007/0184907 | A1 | 8/2007 | Fukutani | |
| 2012/0311870 | A1 | 12/2012 | De | |

* cited by examiner

*Primary Examiner* — Samir Abdosh
(74) *Attorney, Agent, or Firm* — Louis Ventre, Jr.

(57) ABSTRACT

A powered telescoping knife handle has an outer tubular section; inner tubular members; a discharge chamber; a cap; a firing pin; and a release mechanism. The outer tubular section is what is held in the hand of a person. The inner tubular members are nested within the outer tubular section to telescope out to form a spear-like extended handle. The discharge chamber therewithin is suitable to hold a blank cartridge. The cap is removably mounted to the outer tubular section. The firing pin is connected to the cap so as to be removable with the cap and when the cap is attached, the firing pin is positioned to strike the blank cartridge when released. The strike causes the primer charge to explode and propel the inner tubular members away from the cap. The release mechanism is the trigger that releases the firing pin to strike blank cartridge.

7 Claims, 2 Drawing Sheets

POWERED TELESCOPING KNIFE HANDLE

TECHNICAL FIELD

In the field of cutlery, a telescoping knife handle has a removable cap and firing pin for adding a blank cartridge to an inner firing chamber. The handle has nested tubular members that extend the handle to its maximum length by explosion of the blank cartridge within the handle.

BACKGROUND ART

One of the most important tools that mankind has used throughout history on Earth has been the knife. One of the primary uses of the knife has been as a weapon. Even in today's high-tech military with lasers, drones, and robotics, most soldiers are still issued a knife to use as an additional backup weapon. The famous KA-BAR combat knife that was issued to soldiers in World War II was a very important weapon to many soldiers on the battlefield.

A ballistic knife is one that ejects the knife blade. In this case, the handle only serves as the launching platform for the knife blade. Thus, the ballistic knife has a detachable blade that can be ejected to a distance by pressing a trigger or operating a lever or switch on the handle. The ballistic knife is like a firearm in that the blade becomes an independent projectile that is launched from the handle. Unlike a bullet, the ballistic knife has no aerodynamic or gyroscopic stabilization and the blade begins to tumble after traveling a short distance.

A switchblade is a type of knife with a folding or sliding blade contained in the handle which is opened automatically or by gravity assist. Typically, it is spring operated with a button, lever, or switch on the handle, which is activated to move the blade. Here again, except for the button, the handle is motionless: The blade itself is what is rotated or moved when a spring extends the blade to the fully opened position. The blade is unlocked by manually operating a mechanism that unlocks the blade and allows it to be folded and locked in the closed position.

Since knives have been around for so long, it seems as though the handle to the knife has been mostly overlooked by inventors to creatively improve their technology. A knife in the Stone Age had a handle and a blade, and a knife in our current high-tech military still has a handle and a blade.

SUMMARY OF INVENTION

A powered telescoping knife handle has an outer tubular section; inner tubular members; a discharge chamber; a cap; a firing pin; and a release mechanism. The outer tubular section is what is held in the hand of a person. The inner tubular members are nested within the outer tubular section to telescope out to form a spear-like extended handle. A spring-actuated detent mechanism may be employed to lock each inner tubular member in place when telescoped out of the outer tubular section. The discharge chamber therewithin is suitable to hold a blank cartridge. The cap is removably mounted to the outer tubular section. The firing pin is connected to the cap so as to be removable with the cap and when the cap is attached, the firing pin is positioned to strike the blank cartridge when released. A spring or a magnet may be used to bias the firing pin so that the firing pin strikes the cartridge when the firing pin is drawn away from the blank cartridge and released. The strike causes the primer charge to explode and propel the inner tubular members away from the cap. The release mechanism is the trigger that releases the firing pin to strike blank cartridge. A knife blade may be attached to the innermost tubular member.

Technical Problem

Even though the knife is reliable as a weapon, it has some major technical drawbacks: one drawback is the fact that the knife will only extend out as far as the soldier's arm will reach, which requires the soldier to be very close to the enemy, which can result in great danger. If you are close enough to stab the enemy, he is also close enough to stab or cut you.

Another drawback is that the knife relies on the speed and mobility of the soldier to use it. If the enemy is faster swinging or plunging his knife, the soldier will be a bloody casualty.

Another drawback is that often in a knife fight, the strength of the soldier or the enemy is often a determining factor. A female soldier is often no match for the strength of a male enemy.

If only there were a way to improve knife technology to eliminate the drawbacks of dangerous closeness, speed and mobility, and physical strength, the knife could be a much more useful and deadly weapon to better protect and safeguard our soldiers.

Solution to Problem

The solution is a new, improved knife technology involving the power telescoping knife handle. The power telescoping knife handle works by having a telescoping knife handle that will extend and quickly shoot the blade toward the enemy and plunge the blade into the enemy's body. The telescoping handle sections have a propellant force that quickly shoots the blade toward the enemy.

In most circumstances this would be gunpowder, or the gunpowder in a blank cartridge that ignites to shoot the sections forward, but the force could also come from a diamagnetic or electric type of repulsive force.

The butt end of the knife handle, or cap, can be easily opened to insert a blank cartridge, such as a .22 blank.

The back of the butt end also has a pull-back cocking plunger or hammer that will strike the cartridge to force the telescoping section out.

Once the power telescoping knife handle is loaded and cocked, the soldier can just keep using it like a regular knife or he can push the release slide or button with his thumb to force the power telescoping knife handle to rapidly extend.

Advantageous Effects of Invention

The power telescoping knife handle eliminates the need for the soldier to get dangerously close to the enemy.

The power telescoping knife handle eliminates the need for the soldier to have more physical speed and mobility than the enemy.

The power telescoping knife handle eliminates the need for physical strength in a knife fight, so now the smallest, petite female soldier can now be victorious in a knife fight against a very strong male enemy.

The enemy will think he is safe because he is not close enough to be struck by the knife. In the blink of an eye, before he knows what is going on, the power telescoping knife handle will fire and the dead enemy will have a knife blade sticking through his heart, sticking through his neck, sticking through his eye socket into his brain, or any other vital area.

The power telescoping knife handle can use the element of surprise because the enemy thinks the soldier only had a regular knife in his hand and is not close enough to strike. If the blade on the knife is a wider blade such as a crescent shape, then the power telescoping knife handle can cut off a limb or a hand with the push of a button.

The power telescoping knife handle technology can not only be used for hand held type knifes, but can be used as a bayonet and fixed onto a riffle or a pistol.

This type of power telescoping knife handle bayonet enables the soldier to remain at a safe distance from the enemy, while still being able to shoot out the power telescoping knife handle with a blade attached to kill the enemy.

The power telescoping knife handle finally improves the long dormant knife technology, and makes the knife a much more usable and versatile weapon.

The power telescoping knife handle is an important new military technology that will help our soldiers to accomplish their missions and return home safely.

BRIEF DESCRIPTION OF DRAWINGS

The drawings illustrate preferred embodiments of the powered telescoping knife handle according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate an embodiment of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
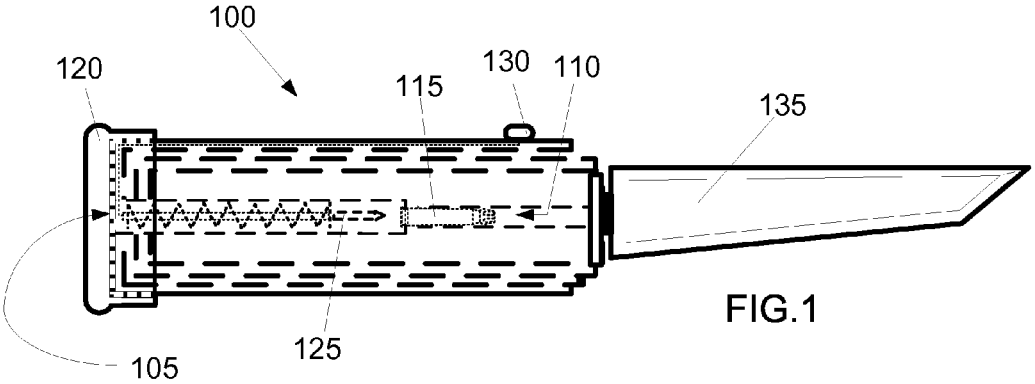
FIG. 1 is a side elevation view of a preferred embodiment of the powered telescoping knife handle in the fully contracted position.
Figure 2:
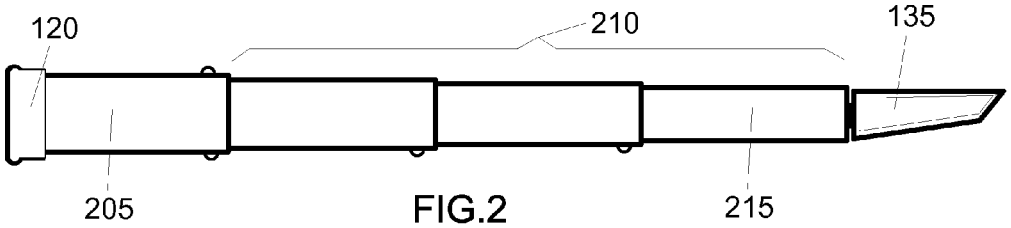
FIG. 2 is a side sectional view of the embodiment of FIG. 1 in the fully extended position.

A preferred embodiment of the powered telescoping knife handle (100) is shown in FIG. 1 in a fully contracted position and in FIG. 2 in a fully extended position. The powered telescoping knife handle (100) includes: an outer tubular section (205); a plurality of inner tubular members (210); a discharge chamber (110); a cap (120); a firing pin (125); and a release mechanism (130).

Figure 5:
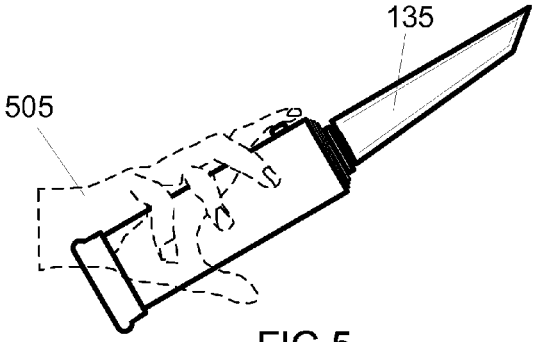
FIG. 5 is a side elevation view of the embodiment of FIG. 1 in a person's hand.

The outer tubular section (205) is adapted to be held in a hand of a person (505), as shown in FIG. 5. Thus, outer tubular section (205) has a size and shape to conveniently be carried in a person's hand, much like the haft of an ordinary knife. When all of the plurality of inner tubular members (210) are contracted into the outer tubular section (205), the outer tubular section (205) is comparable to the haft of the ordinary knife, albeit extended somewhat by the ends of the plurality of inner tubular members (210) protruding out from the outer tubular section (205).

The outer tubular section (205) has a loading end (105), where a blank cartridge (115) is loaded into a discharge chamber (110) within the outer tubular section (205). The loading end (105) is opposite the end where a knife blade (135) may be attached.

The plurality of inner tubular members (210) is nested within the outer tubular section (205), so that they can be telescoped out to extend the length of the handle, as shown in FIG. 2. When telescoped out, the handle remains a single connected tubular device. Each inner tubular member in the plurality of inner tubular members (210) is interlocked so that each may not physically separate from the next larger diameter tubular member, but rather each is telescoped out so that the plurality of inner tubular members (210) form a spear-like extended handle, as shown in FIG. 2.

Figure 3:
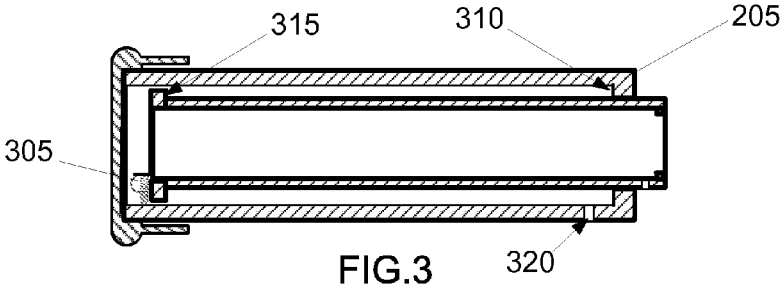
FIG. 3 is a sectional view showing a spring-actuated detent mechanism for locking the tubular members in an extended position and the lips that prevent detachment of the nested tubes.
Figure 4:
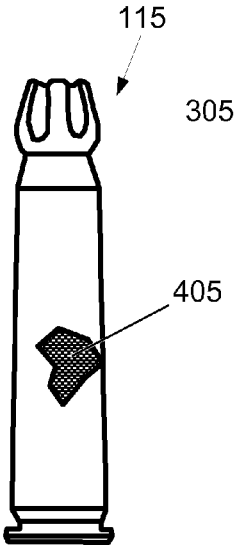
FIG. 4 is a side elevation view of a blank cartridge.

Prevention of the removal of any inner tubular member from the handle is preferably accomplished, as illustrated in FIG. 3, using an inner circumferential lip (310) at the knife end of the outer tubular section (205) which engages an outer circumferential lip (315) of the next smaller diameter inner tubular member when that member is extended to its maximum travel distance. Similarly, the combination of outer and inner lips prevents separation of the nested plurality of inner tubular members (210).

Each inner tubular member in the plurality of inner tubular members (210) telescopes out of the outer tubular section (205), or more specifically telescopes out near the end of the next larger diameter tubular member among the nested tubular members. The smallest diameter tubular member is the innermost such nested tubular member. Thus, the plurality of inner tubular members (210) includes an innermost tubular member (215).

The discharge chamber (110) is within the outer tubular section (205), preferably coaxially positioned therewithin. The discharge chamber (110) is analogous to the chamber of a firearm except that the discharge chamber (110) in the powered telescoping knife handle (100) holds a blank cartridge (115) so that its primer charge (405) can be exploded, thereby creating a propulsive force to power the extension of the plurality of inner tubular members (210). Thus, the discharge chamber (110) is suitable to hold a blank cartridge (115), the blank cartridge (115) having a primer charge (405).

The blank cartridge (115) is of a type often used in a firearm to create a noise and a flash, such as for example in military training maneuvers, funeral honors, and movies. Blank cartridges, also known simply as blanks, are also commonly used in starter pistols to signal the beginning of a race. Blank cartridges are also known and also used for their propellant force in fields such as construction, shooting sports, and fishing. Similarly the blank cartridge (115) creates the propellant force to extend the plurality of inner tubular members (210) in the powered telescoping knife handle (100). The blank cartridge (115) as used herein contains gunpowder but no bullet or shot. The gunpowder is referred to herein as a primer charge (405).

The cap (120) is the cover over the loading end (105) of the outer tubular section (205). The cap (120) is removably mounted to the loading end (105) of the outer tubular section (205), preferably with a simple threaded connection. In the preferred embodiment, the cap (120) is screwed on the outer tubular section (205). Alternatively, it may be connected using spring detent, a hinge and lock, or any other means for attachment.

The firing pin (125) is connected to the cap (120) so as to be removable with the cap (120). When the cap (120) is removed, the firing pin (125) comes out with it and exposes the discharge chamber (110) so that a blank cartridge (115) can be loaded into the discharge chamber (110). The firing pin (125) used in the powered telescoping knife handle (100) may sometimes be referred to as a striker, which is basically a spring-loaded firing pin. Thus, the powered telescoping knife handle (100) may include a spring (605) to bias the firing pin (125) so that the firing pin (125) strikes the cartridge when the firing pin (125) is drawn away from the blank cartridge (115) and released.

With the cap (120) connected to the outer tubular section (205), the firing pin (125) is positioned to strike the blank cartridge (115) when the firing pin (125) is released, such as by activation by a trigger mechanism or by manually pulling and releasing the firing pin (125). When the firing pin (125) is released, the firing pin (125) thereafter strikes the blank cartridge (115). The firing pin (125) strike on the blank cartridge (115) causes the primer charge (405) to explode and propel the plurality of inner tubular members (210) away from the cap (120) and into a fully extended position.

The release mechanism (130), which is analogous to a trigger on a firearm, is accessible from the outer tubular section (205). The release mechanism (130) is adapted to release the firing pin (125) to strike blank cartridge. The firing pin (125) may be locked in a pulled-back or cocked position before screwing on the cap (120) and then released by the release mechanism (130). Once released, a biasing mechanism propels the firing pin (125) toward the blank cartridge (115). Exemplary biasing mechanisms include the spring (605) and a magnet (705). Thus, the powered telescoping knife handle (100) may include a magnet (705) to bias the firing pin (125) so that the firing pin (125) strikes the cartridge when the fining pin is drawn away from the blank cartridge (115) and released.

Figure 6:
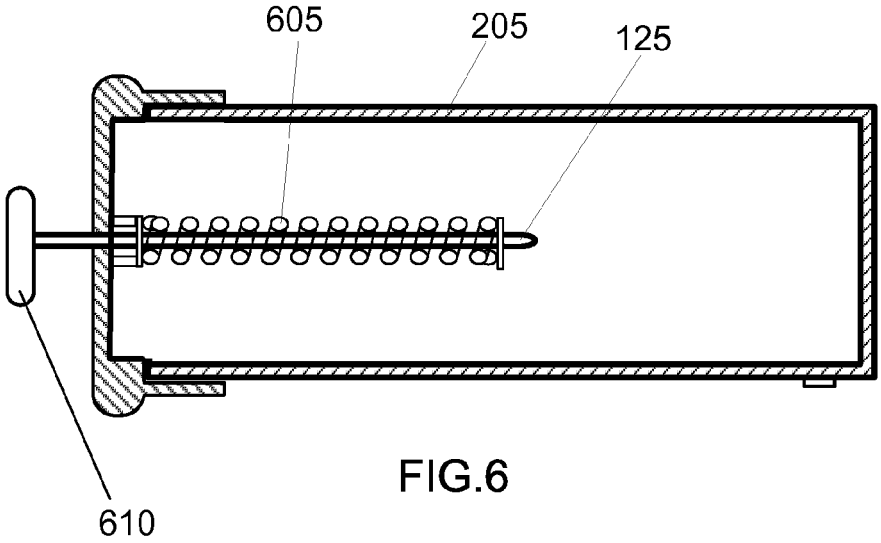
FIG. 6 is a sectional side view of an alternative embodiment of the outer tubular section with a firing pin for manual activation with a spring.
Figure 7:
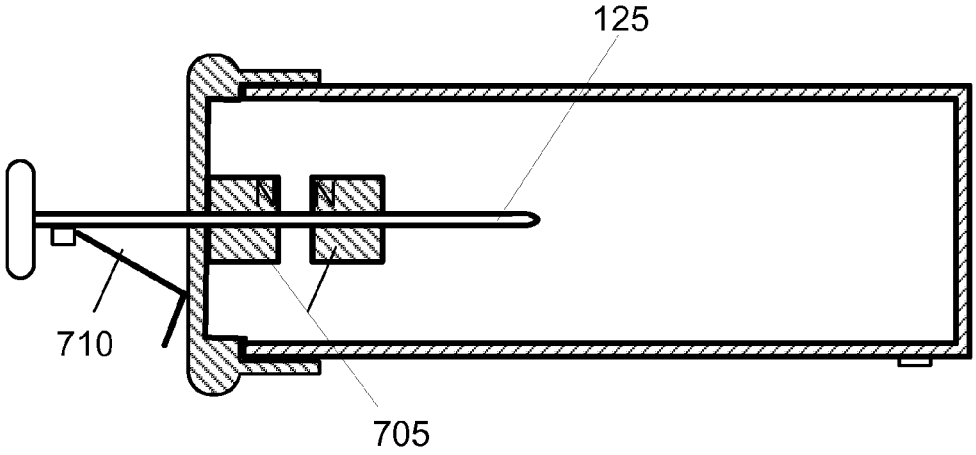
FIG. 7 is a sectional side view of an alternative embodiment of the outer tubular section with a firing pin for manual activation with a magnet.

Alternatively, simple pull and release firing mechanisms, such as illustrated in FIG. 6 and FIG. 7 may be used. In FIG. 6, a knob (610) is used to pull back the firing pin (125) against the force of the spring (605). In FIG. 7, the knob (610) is similarly used to pull back the firing pin (125) against the repulsive force of the magnets (705). One magnet may be used, such as for example when employing a strongly diamagnetic material for the cap (120) or the firing pin (125), such as pyrolytic carbon or bismuth. These pull and release firing mechanisms may also be used in combination with a locking mechanism (710) to allow cocking and simple lever release of the locking mechanism.

The powered telescoping knife handle (100) may include a spring-actuated detent mechanism (305), a preferred version of which is shown in FIG. 3. In this embodiment, the spring-actuated detent mechanism (305) is attached to an inner circumferential lip (310) so that it does not interfere with the movement of the plurality of inner tubular members (210) but can easily enter a mating hole (320) in the next larger diameter tube.

The mating hole (320) designated in FIG. 3 is in the outer tubular section (205) and one would be in each corresponding inner tubular member below each inner circumferential lip (310). The spring-actuated detent mechanism (305) is adapted to lock each inner tubular member in the plurality of inner tubular members (210) in place when telescoped out of the outer tubular section (205). For this embodiment, the plurality of inner tubular members (210) may be ribbed with each rib traveling in a channel in the next outer tubular member. This ribbed-channel arrangement ensures that each tubular member travels in the same path to the extended position so that the spring-actuated detent mechanism (305) mates up with the mating hole (320).

Alternatively, the spring-actuated detent mechanism (305) may be miniaturized to fit within the wall of each inner tubular member in the plurality of inner tubular members (210). Alternatively, the spring-actuated detent mechanism (305) may fit between walls of the plurality of inner tubular members (210). In this configuration, the plurality of inner tubular members (210) may have slots in them to allow their transit between the contracted position of FIG. 1 and the extended position of FIG. 2.

The plurality of inner tubular members (210) may have a spiral track or slot that guides the extension of the plurality of inner tubular members (210) outward so that the knife blade (135) spins around the longitudinal axis of the plurality of inner tubular members (210) as the powered telescoping knife handle (100) is powered to the extended position. This creates the potential for a larger wound in the target.

The powered telescoping knife handle (100) may have a knife blade (135), a spike, a blunt object, or any number of other attachments fixed at the end of the innermost tubular member (215). Preferably, the powered telescoping knife handle (100) has the knife blade (135) attached in a fixed position to the innermost tubular member (215). If attached, the knife blade (135) is preferably rigidly affixed so that it cannot fold, slide, move or shift relative to the innermost tubular member (215) to which it is attached.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the weapons industry.

What is claimed is:

1. A powered telescoping knife handle comprising:

an outer tubular section adapted to be held in a hand of a person, the outer tubular section comprising a loading end;

a plurality of inner tubular members that are nested within the outer tubular section and which telescope out of the outer tubular section to form a spear-like extended handle, the plurality of inner tubular members comprising an innermost tubular member;

a spring-actuated detent mechanism adapted to lock each inner tubular member in the plurality of inner tubular members in place when telescoped out of the outer tubular section;

a discharge chamber within the outer tubular section, the discharge chamber being suitable to hold a blank cartridge, the blank cartridge comprising a primer charge;

a cap removably mounted to the loading end of the outer tubular section;

a firing pin connected to the cap so as to be removable with the cap, wherein with the cap connected to the outer tubular section, the firing pin is positioned to strike the blank cartridge when released, wherein the strike causes the primer charge to explode and propel the plurality of inner tubular members away from the cap; and a release mechanism accessible from the outer tubular section, the release mechanism adapted to release the firing pin to strike blank cartridge.

2. The powered telescoping knife handle of claim 1, further comprising a knife blade attached to the innermost tubular member.

3. The powered telescoping knife handle of claim 1, further comprising a spring to bias the firing pin so that the firing pin strikes the cartridge when the firing pin is drawn away from the blank cartridge and released.

4. A powered telescoping knife handle comprising:

an outer tubular section adapted to be held in a hand of a person, the outer tubular section comprising a loading end;

a plurality of inner tubular members that are nested within the outer tubular section and which telescope out of the outer tubular section to form a spear-like extended handle, the plurality of inner lobular members comprising an innermost tubular member;

a discharge chamber within the outer tubular section, the discharge chamber being suitable to hold a blank cartridge, the blank cartridge comprising a primer charge;

a cap removably mounted to the loading end of the outer tubular section;

a firing pin connected to the cap so as to be removable with the cap, wherein with the cap connected to the outer tubular section, the firing pin is positioned to strike the blank cartridge when released, wherein the strike causes the primer charge to explode and propel the plurality of inner tubular members away from the cap;

a release mechanism accessible from the outer tubular section, the release mechanism adapted to release the firing pin to strike blank cartridge; and a magnet to bias the firing pin so that the firing pin strikes the cartridge when the firing pin is drawn away from the blank cartridge and released.

5. The powered telescoping knife handle of claim 4, further comprising a spring-actuated detent mechanism adapted to lock each inner tubular member in the plurality of inner tubular members in place when telescoped out of the outer tubular section.

6. The powered telescoping knife handle of claim 4, further comprising a knife blade attached to the innermost tubular member.

7. The powered telescoping knife handle of claim 4, further comprising a spring to bias the firing pin so that the firing pin strikes the cartridge when the firing pin is drawn away from the blank cartridge and released.

* * * * *